US008016132B2

(12) United States Patent
LaRiviere

(10) Patent No.: US 8,016,132 B2
(45) Date of Patent: Sep. 13, 2011

(54) SIDE-ENTRY STEMMED GLASSWARE RACK

(75) Inventor: F. David LaRiviere, Monterey, CA (US)

(73) Assignee: Franmara, Inc., Salinas, CA (US)

( * ) Notice: Subject to any disclaimer, the term of this patent is extended or adjusted under 35 U.S.C. 154(b) by 294 days.

(21) Appl. No.: 12/412,124

(22) Filed: Mar. 26, 2009

(65) Prior Publication Data

US 2010/0243588 A1 Sep. 30, 2010

(51) Int. Cl.
*A47G 29/00* (2006.01)

(52) U.S. Cl. ..... 211/85.29

(58) Field of Classification Search ..... 211/85.29, 211/41.2, 74, 71.01; D6/513, 514; D7/701, D7/708

See application file for complete search history.

(56) References Cited

U.S. PATENT DOCUMENTS 2,772,787 A * 12/1956 Lee ..... 211/75
3,171,544 A * 3/1965 Unsworth ..... 211/41.2
3,491,893 A * 1/1970 Morris ..... 211/60.1
D259,452 S * 6/1981 Hoffman ..... D6/514
D269,926 S * 8/1983 White ..... D6/514
D273,446 S * 4/1984 Rankin et al. ..... D6/514
D275,433 S * 9/1984 Boland, II ..... D6/514
4,700,849 A * 10/1987 Wagner ..... 211/41.2
D304,401 S * 11/1989 Wagner ..... D7/705
D308,924 S * 7/1990 VanNoord ..... D6/513
D393,388 S * 4/1998 Chen ..... D6/513
5,799,802 A * 9/1998 Delia et al. ..... 211/184
6,126,256 A * 10/2000 Doces, II ..... 312/351
6,283,566 B1 * 9/2001 Doces ..... 312/351
6,332,547 B1 * 12/2001 Shaw et al. ..... 211/59.2
D553,454 S * 10/2007 Goodman et al. ..... D7/704
7,900,782 B2 * 3/2011 Goserud et al. ..... 211/85.29
2003/0080077 A1 * 5/2003 Ruiz ..... 211/85.29
2007/0114195 A1 * 5/2007 Patsalaridis ..... 211/85.29

* cited by examiner

*Primary Examiner* — Sarah Purol

(74) *Attorney, Agent, or Firm* — LaRiviere, Grubman & Payne, LLP

(57) ABSTRACT

A side-entry stemmed glassware rack for storing and displaying stemmed glassware. Stemmed glassware is hung in the conventional, inverted manner except that the base of the glassware is inserted into a main track of the rack the via an intersecting side track rather than only from one or both ends of the main track.

4 Claims, 12 Drawing Sheets

(Exploded)

SIDE-ENTRY STEMMED GLASSWARE RACK

BACKGROUND ART

Conventional racks for convenient and safe storage and display of stemmed glassware typically comprise a plurality of tracks for receiving the base of inverted stemmed glassware at one or both ends of each track. Referring to FIG. 1, typical prior art stemmed glassware rack 100 comprises receiving tracks 102. Such racks are often mounted to the underside of suspended horizontal surfaces, such as cupboards or shelving having sufficient space or clearance above a counter-top, sink board, cocktail bar or other working surface to allow glasses 104 to hang in inverted orientation as shown. Glassware bases 105 are fitted into tracks 102 via track openings 103. Each glass 104 is moved along track to make room at the track opening 103 for additional glasses until the track is full. It should be noted that each track is relatively short, usually limited by the depth of the cupboard or width of the shelf from which it is hung.

While some prior art racks can be affixed to vertical walls, they typically require supporting brackets and other hardware for such mounting as shown in FIG. 2. In addition, since the racks are usually orthogonal to the vertical surface of the wall, such racks protrude from the wall to provide insertion of the glass bases into the tracks by at least the length of the tracks. The length of the tracks are usually long enough to hang at least 4-6 glasses. If the glasses are very large, the distance outward from the wall can be as much as 10-12 inches.

DISCLOSURE OF THE INVENTION

The side-entry, tracked, stemmed glassware rack of the present invention comprises at least one main track for receiving the base of stemmed glasses via a relatively short, intersecting side track. The rack of the present invention can be mounted to any vertical or horizontal surface without additional supporting brackets or hardware.

Since the width of the main track can be generally as narrow as the diameter of a single glass, if the rack of the present invention is mounted to a vertical wall, protrusion of the rack will be approximately the same as the diameter of a single glass hung in the track.

The glassware rack of the present invention may comprise more than one main track and more than one side track to accommodate the varying room, bar, restaurant, and work space configurations. The length of the main track also can be varied to accommodate the transverse width of the vertical or underside horizontal surface to which it is to be mounted.

BEST MODE FOR CARRYING OUT THE INVENTION

Figure 3A:
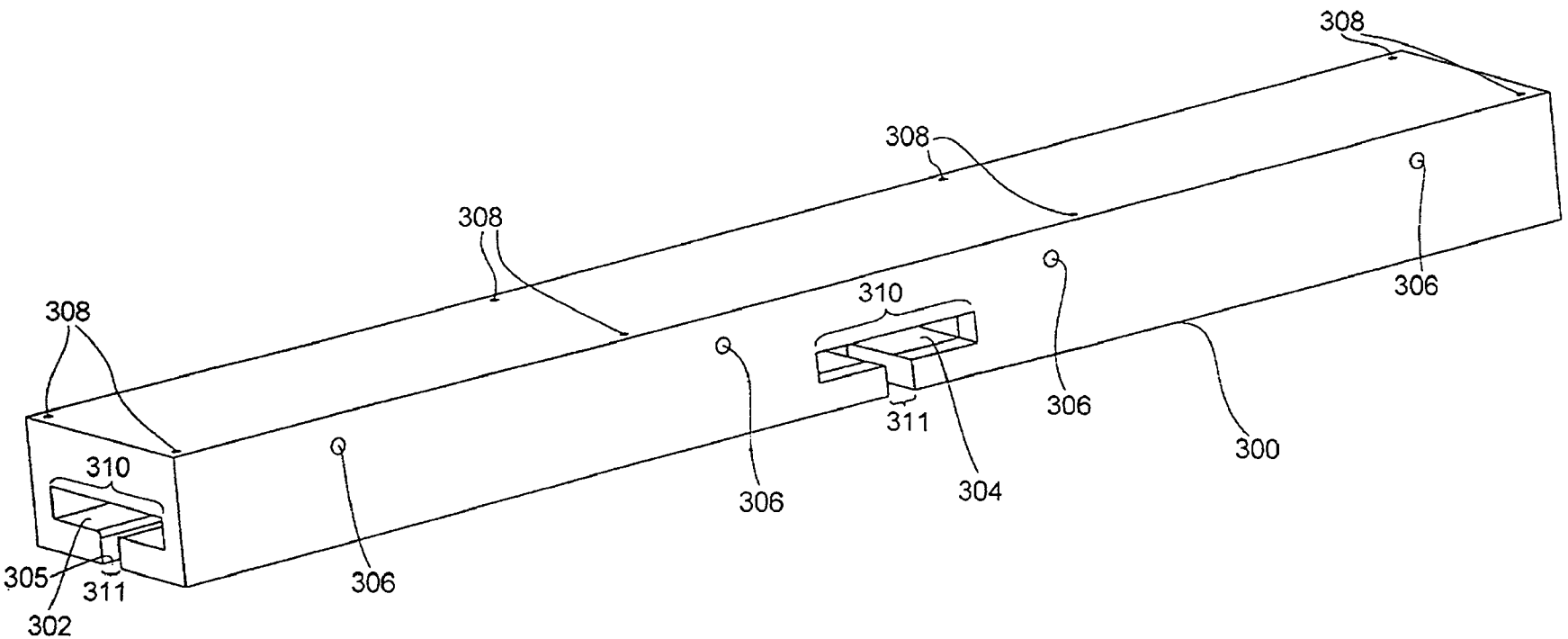
FIG. 3A illustrates one embodiment of a stemmed glassware rack according to the present invention.
Figure 3B:
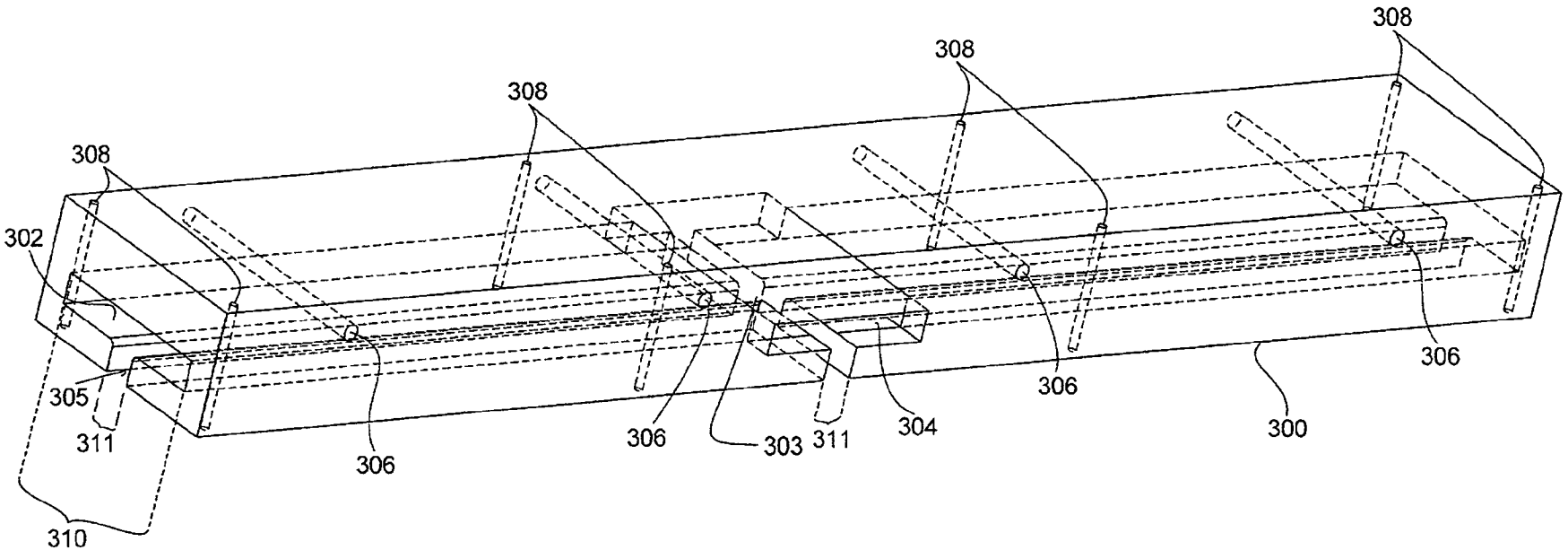
FIG. 3B illustrates the one embodiment of FIG. 3A showing internal and mounting structure thereof.

Referring to FIGS. 3A and 3B, rack 300 comprises main track 302 formed generally along a center longitudinal axis. Rack 300 can be of any convenient length. Side entry track 304 orthogonally intersects main track 302 at intersection 303. Main track 302 receives the bases of glasses for inverted storage and display of stemmed glasses via side track 304. Depending on the location of side track 304 along the axis of track 302, glasses may be slid along track 302 in either direction as glasses are added to the track. Track 302 may also include open ends 305 for receiving the bases of glassware to be hung from track 302.

Main and side tracks 302 and 304, respectively, include wide portions 310 and narrow portions 311. The height and width of wide portions 310 are dimensioned to accept the base of the stemmed glasses. The height and width of narrow portions 311 are dimensioned to accept the stem of the glasses, and intersect in parallel configuration with wide portions 310. The dimensions of both wide and narrow portions 310 and 311, respectively, should accommodate the generally widening effect of the transition between the base and stem of the glassware to be hung in the rack of the present invention.

While the intersection of tracks 302 and 304 are shown and described as orthogonal to one another, that orthogonality is not required though generally desirable to facilitate ease of construction and use. However, if the configuration of the installation permits, side track 304 may intersect main track 302 at any convenient angle that can be reasonably constructed.

With continuing reference to FIGS. 3A and 3B, track 302 is formed somewhat below the centerline of rack 300 to provide sufficient material above track 302 for countersunk mounting holes 306 disposed along the length of the rack 300 at intervals as desired for mounting to vertical walls. In one embodiment, holes 306 are located at intervals approximating the distance between studs of the walls of a commercial building which may house restaurants or a private home.

In addition to mounting holes 306, mounting holes 308 are also provide for mounting rack 300 to the underside of a cupboard shelf. Care must be take to provide sufficient material on one or both sides of the track 302 to avoid interference between track 302 and mounting holes 308 as shown.

Figure 3C:
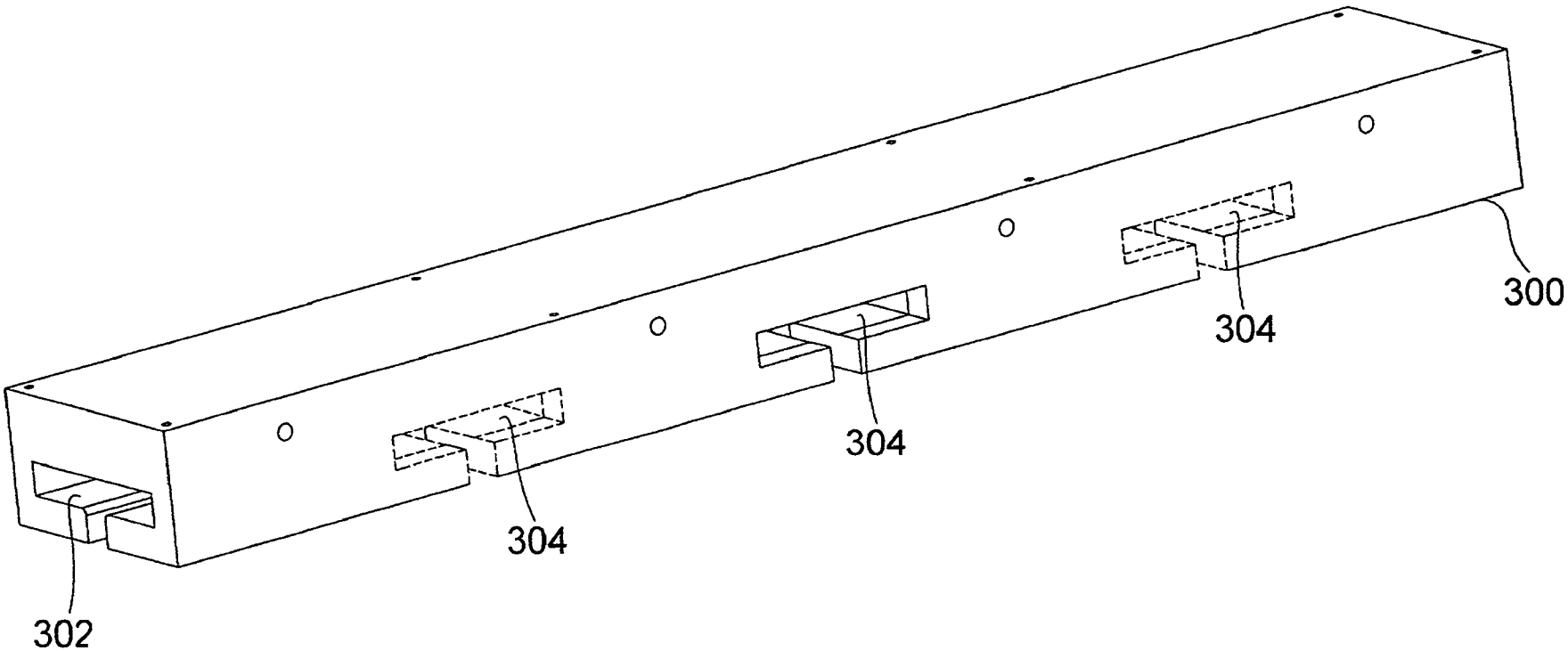
FIG. 3C is the embodiment of FIG. 3A showing additional side-entry tracks.
Figure 3D:
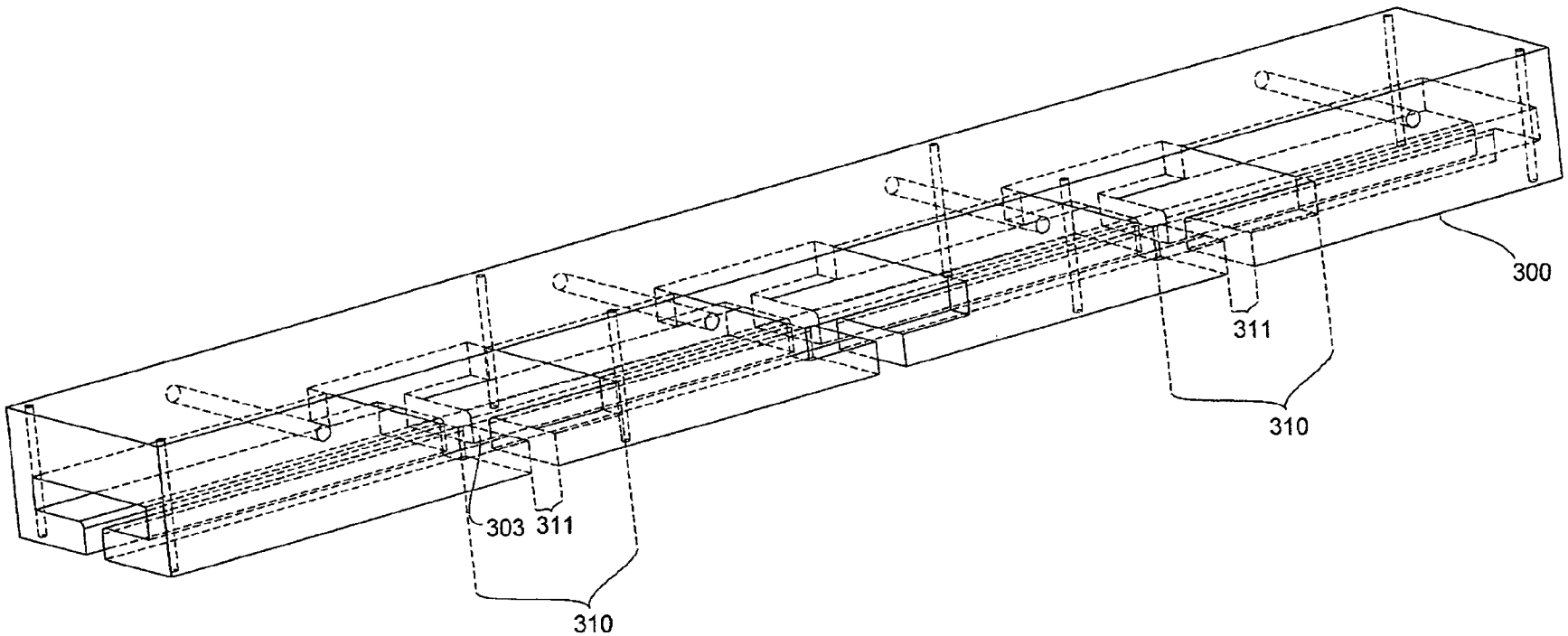
FIG. 3D is the embodiment of FIG. 3C showing internal and mounting structure thereof.

Referring now to FIGS. 3C and 3D, another embodiment of a stemmed glassware rack according to the present invention comprises more than one main track 302. Additionally, it may also include more than one side track 304 which intersect main track 302 at intersections 303. As also shown in FIGS. 3B and 3D, side tracks 304 can be extended by intersections 303 to the other side of rack 300 to accommodate entry of glassware from the other side as desired.

Figure 4A:
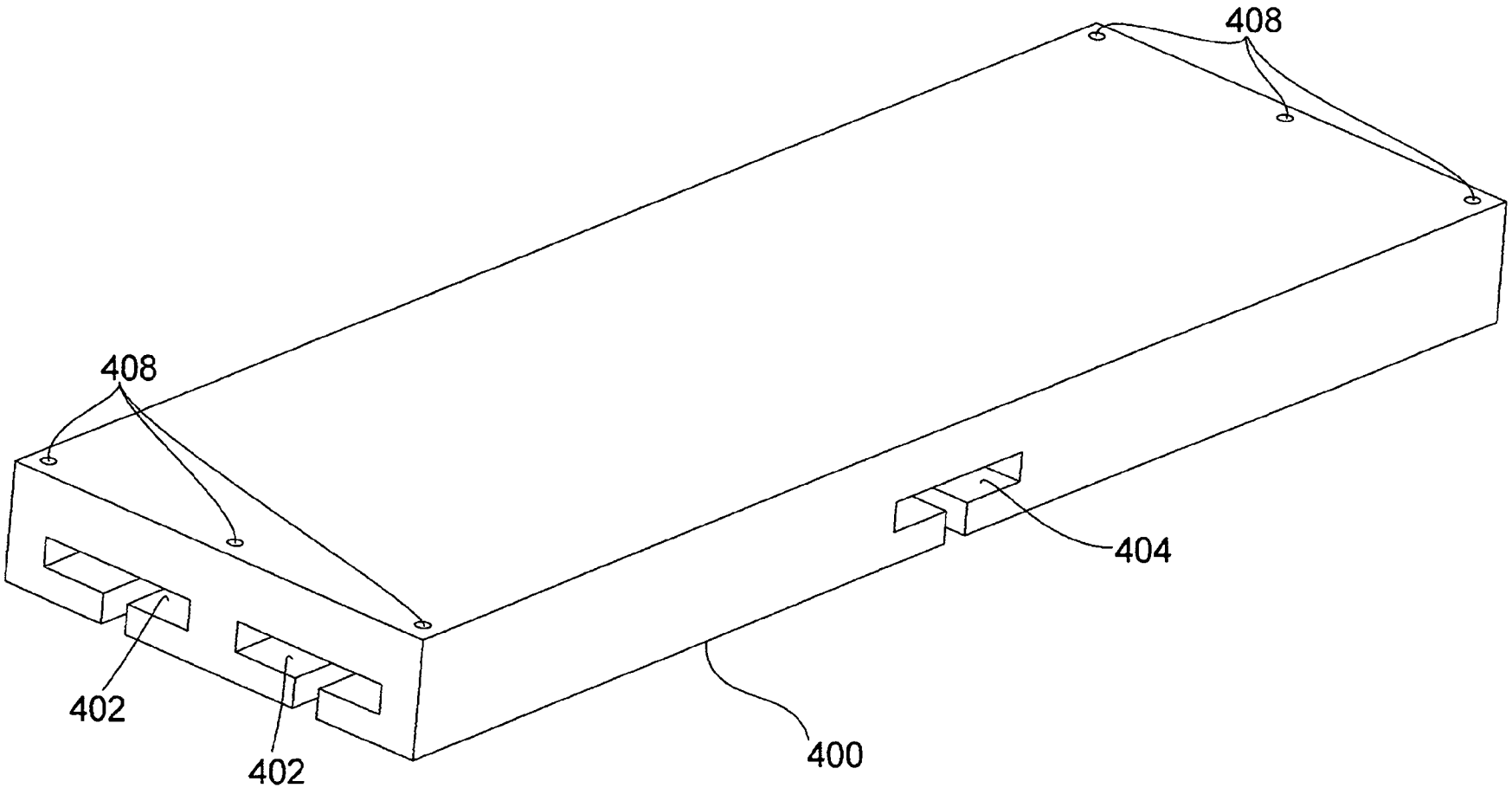
FIG. 4A illustrates another embodiment of a stemmed glassware rack according to the present invention.
Figure 4B:
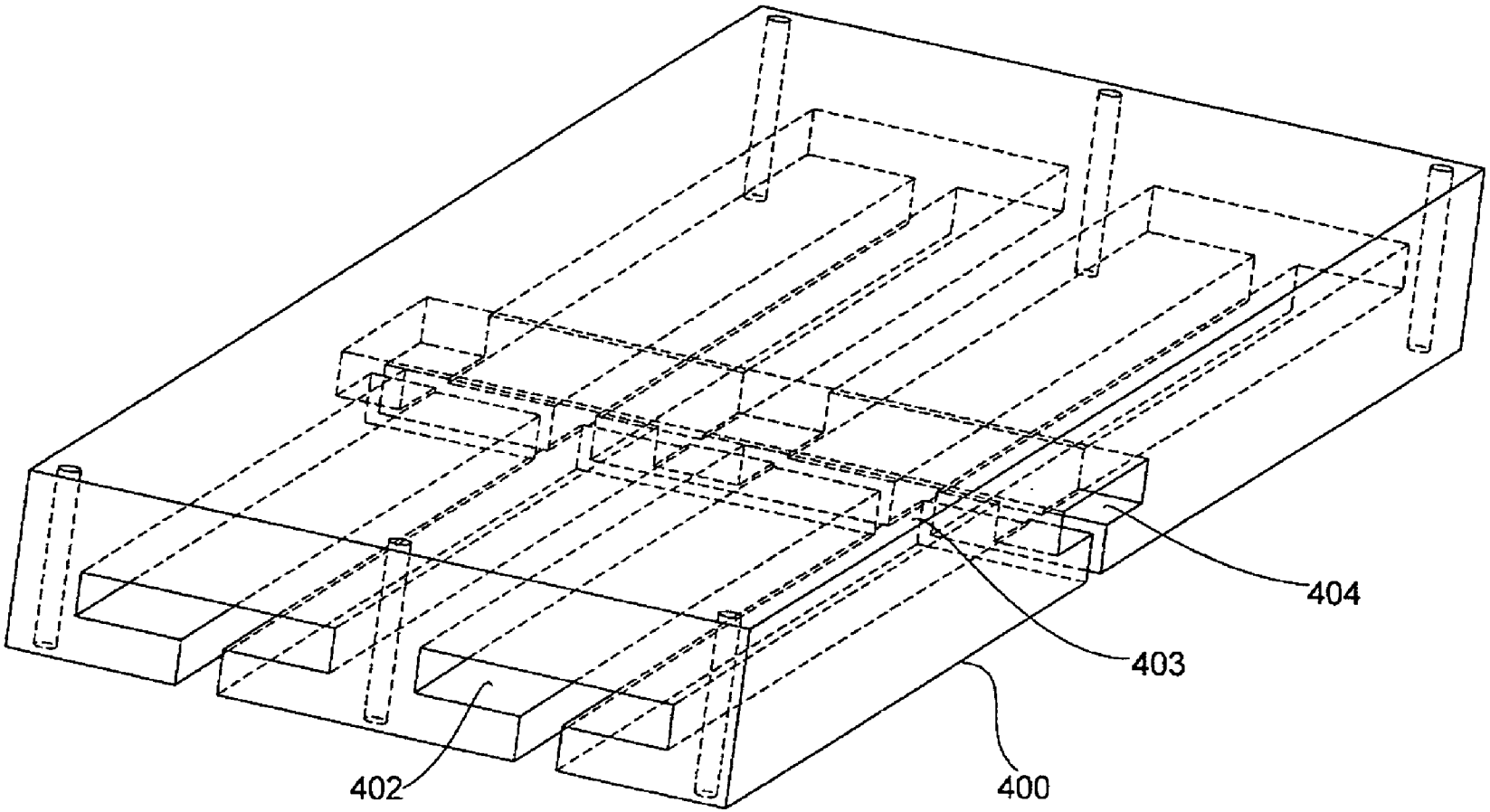
FIG. 4B illustrates the embodiment of FIG. 4A showing internal and mounting structures thereof.

Referring now to FIGS. 4A and 4B, rack 400 comprises at least one additional main track 402 and at least one side track 404 which intersects both main tracks 402 at 403. Obviously, additional side tracks 404 (not shown) may be added. Mounting holes 408 are provided for mounting rack 400 to the underside of a horizontal surface.

Figure 1:
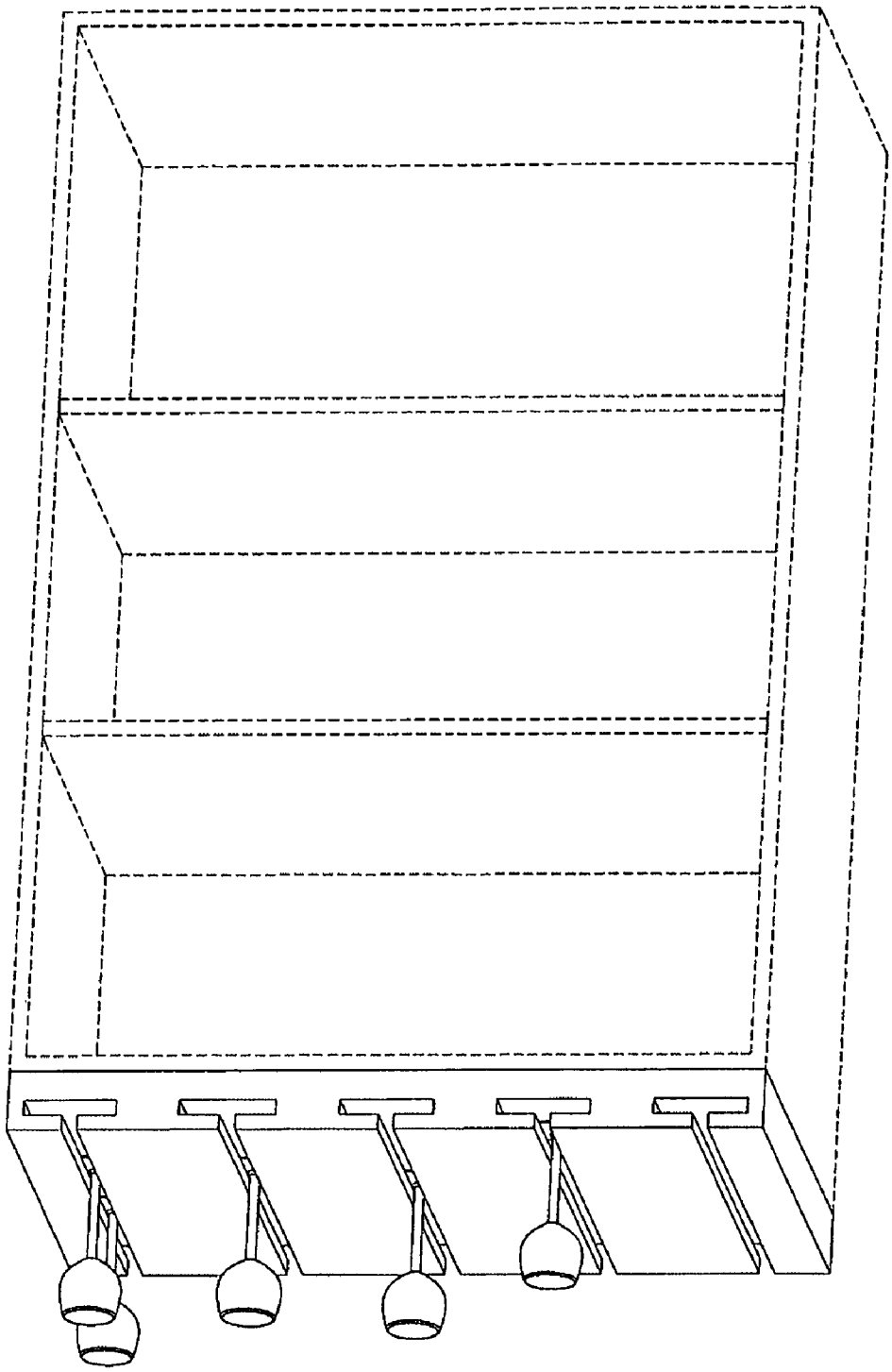
Figure 1 (Prior Art)
FIG. 1 illustrates a prior art stemmed glassware rack mounted to the underside of a cupboard or shelf.
Figure 2:
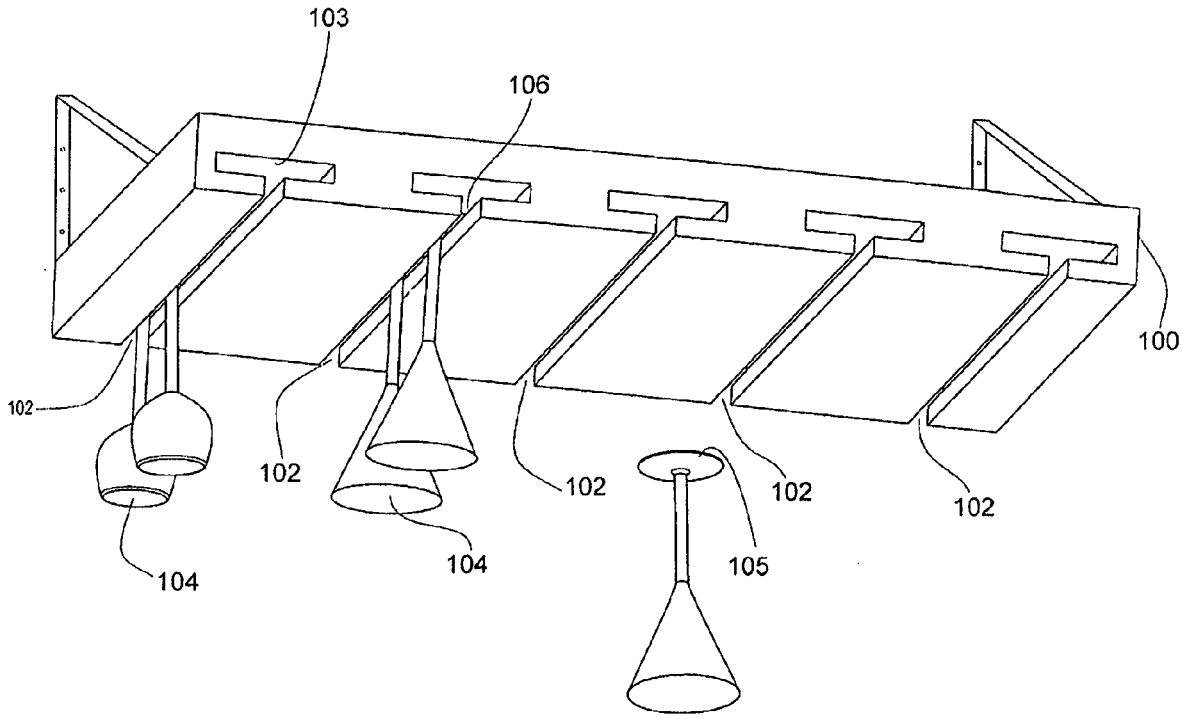
Figure 2 (Prior Art)
FIG. 2 illustrates the prior art rack of FIG. 1 mounted to a vertical wall.

For mounting rack 400 to a vertical wall, support brackets such as those shown in FIG. 2 for prior art racks may be used.

Alternatively, mounting of either rack 300 or 400 may be achieved using hardware shown for mounting, storing and display shelves commonly offered by home furnishing retailers. See for example, Pottery Barn catalog item number 97-6492938. In order to hide the hardware and improve appearance, the back face of racks 300 or 400, which mates to the vertical wall, would require enough material to provide a recessed cavity to accommodate the mounting hardware. The mounting hardware forms no part of the present invention.

The rack of the present invention can be formed in any material suitable for supporting the weight of such glassware, including wood, plastic, metal and the like. The embodiments shown are generally made of wood or other solid material capable of being milled, glued and otherwise cut, drilled and worked by cutting and milling tools such as routers and the like. In one embodiment, the rack is made from a single wooden work piece, suck as oak, having width generally greater than the width of the base of a typical stemmed glass, and a thickness generally greater than the thickness of the base of the glasses to be hung therefrom, plus the material needed for mounting holes. The tracks are formed using a router bit dimensioned for the width and thickness of the bases of the glasses, and for the diameter of the stem of the glasses as discussed elsewhere in this specification.

Figure 5A:
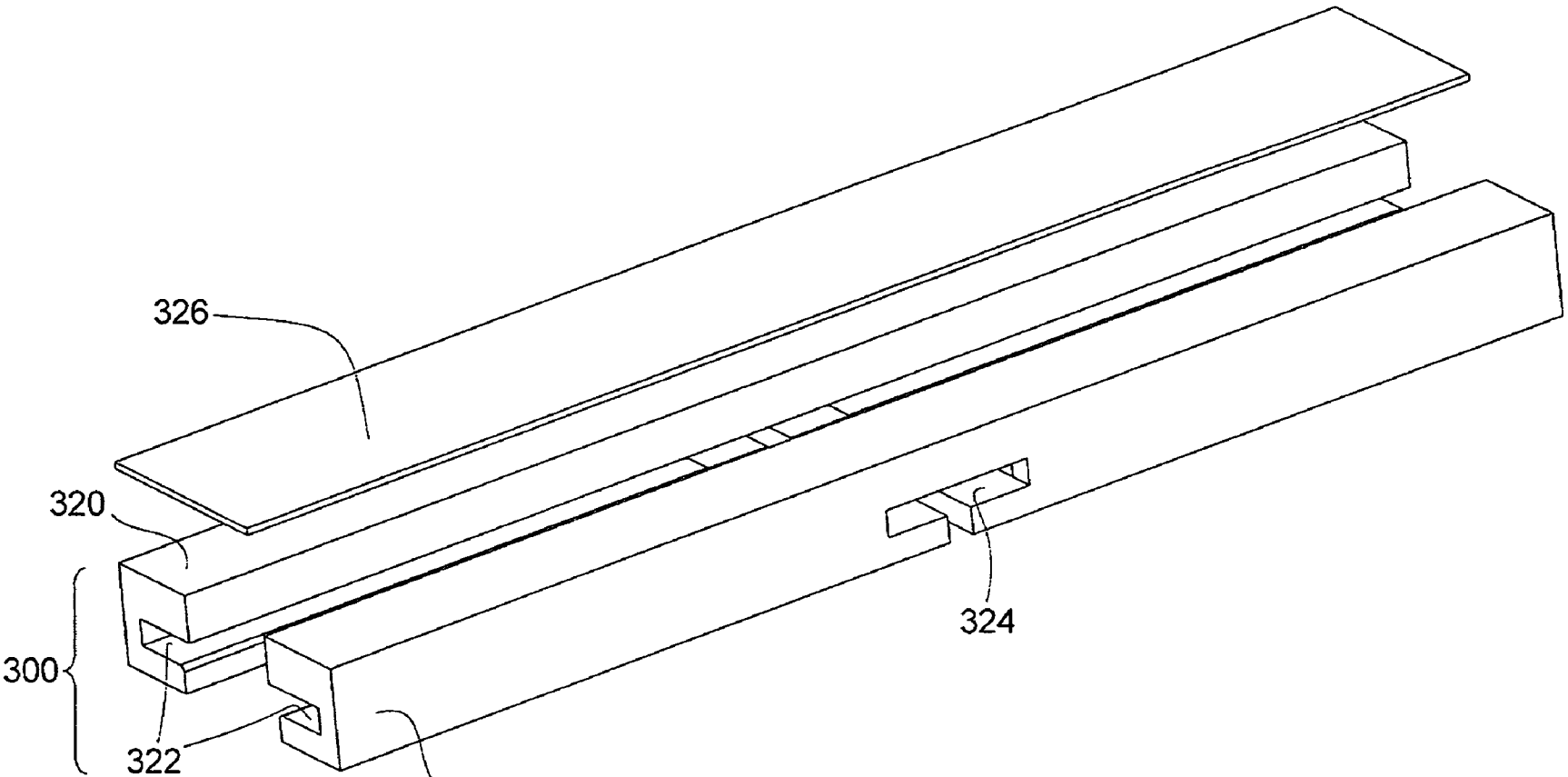
FIGS. 5A-5C illustrate methods of constructing the stemmed glassware rack of the present invention.
Figure 5B:
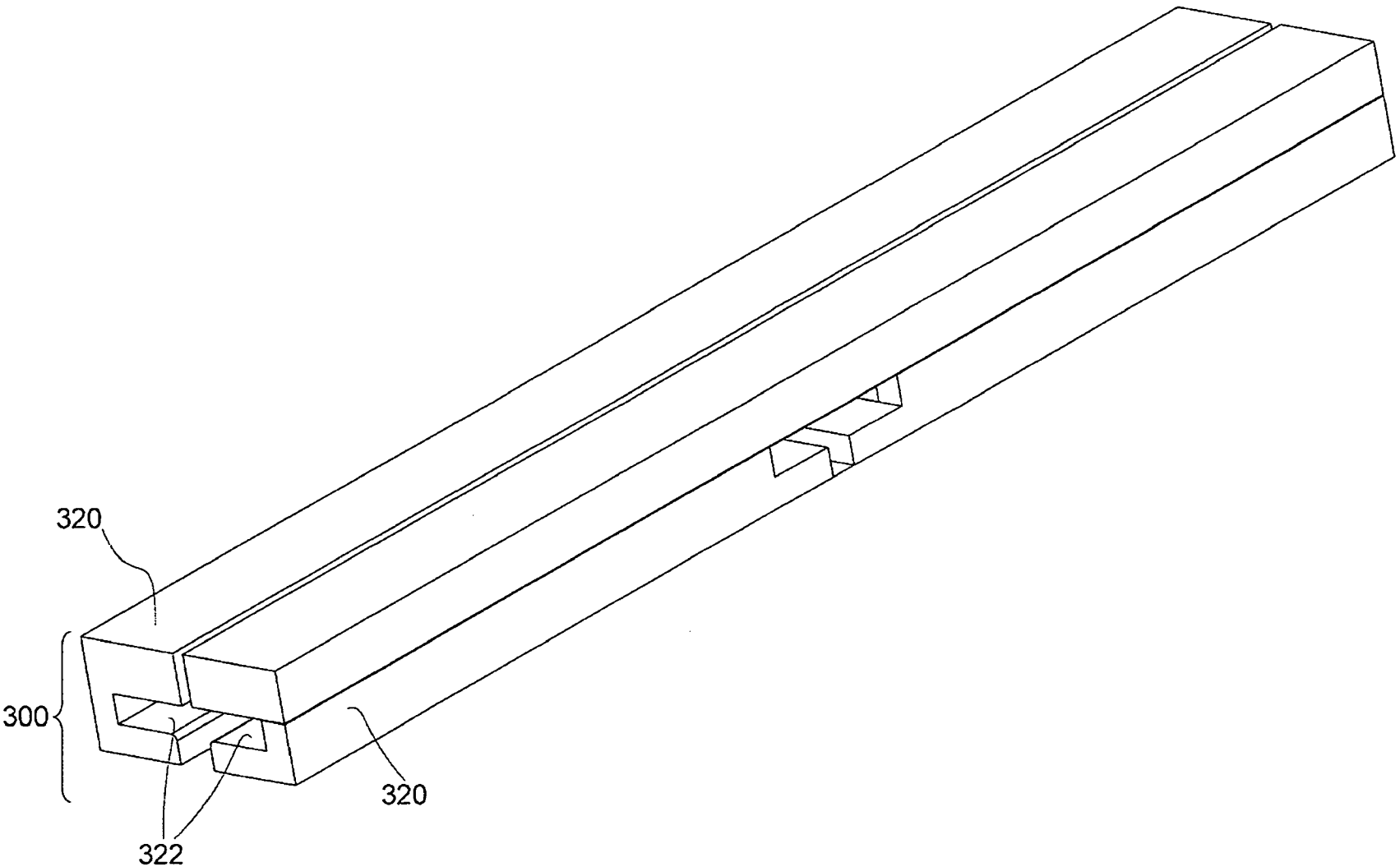
Figure 5C:
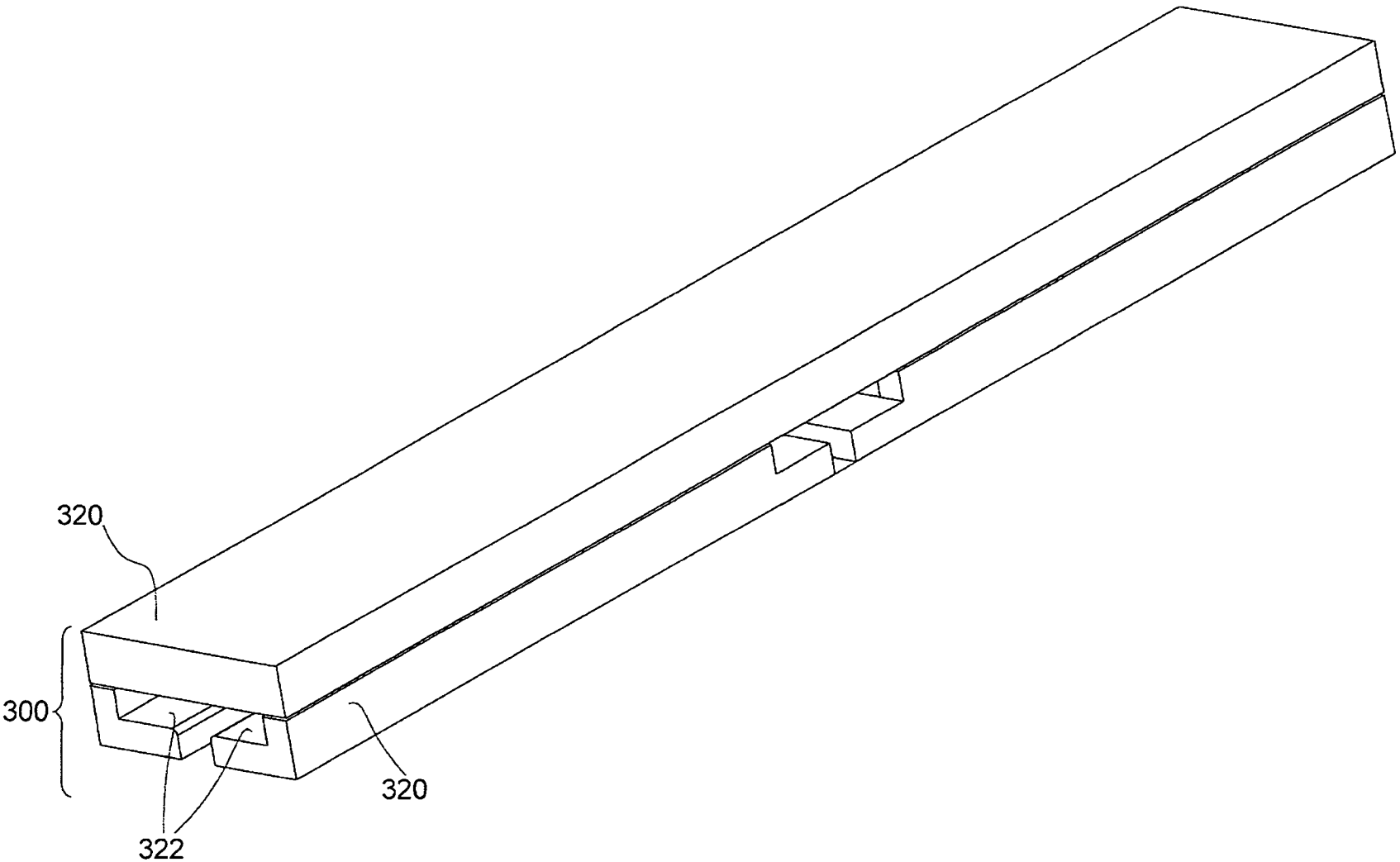

Exploded views of rack 300 are shown and formed from separate sections of wood as shown in FIGS. 5A-5C. Side sections 320 are formed to include half-tracks 322 and partial side tracks 324. When assembled, side sections 320 arc disposed along and affixed to top section 326 with half-tracks 322 opposed to form main track 302 and side track 304 as shown in FIG. 3. Side sections 320 may affixed to top section 326 in any number of ways, including by means of glue, screws, nails or the like. The widths of side sections 320 are approximately one-half the width of the width of track 302.

Figure 6:
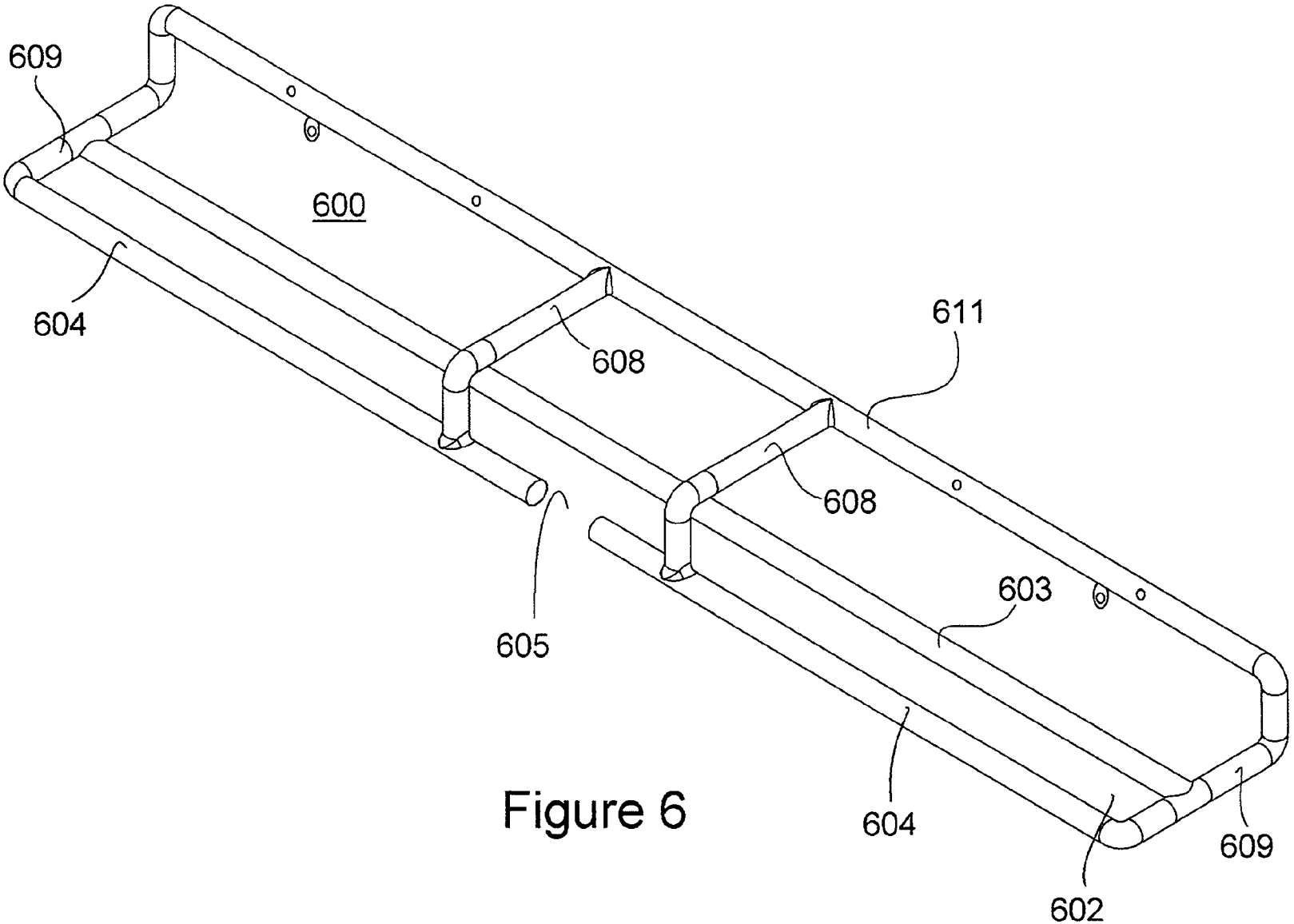
FIG. 6 illustrates another embodiment of the stemmed glassware rack according to the present invention.

FIG. 6 shows another embodiment of the present invention constructed of tubular or solid metal bar material. Rack 600 comprises main track 602 formed between bars 603 and 604. Side entry 605 is formed between the ends of bars 604. Bars 604 are supported near side entry 605 by support bars 608.

Mounting tabs 612 are provided for attaching rack 600 to a vertical wall. Alternatively, if the tubular or bar material is of sufficient diameter and strength, mounting of rack 600 can be achieved by simply drilling holes through bar 611 at convenient locations along its length. Similarly, additional support bars 608 can be added to each end of rack 600 and holes drilled there through for mounting to the underside of a horizontal surface.

Finally, it should be noted that width of track 602 may be adjusted by varying the location of bar 603 along side bars 609. Bar 603 can be permanently affixed to or detachably connected to side bar 609 so as to provide selectably variable width of track 602 to accommodate different sized glasses. One simple configuration for detachment of bar 603 would be to form a clamp at each end of bar 603 for clamping to support bar 609 with a set screw.

Any number of other ways to construct the rack of the present invention are possible. A few dimensions must be determined with care, such as the width and thickness of the material for forming main track 302, and the amount of the material above and to the sides of the main track to assure sufficient clearance for mounting holes. In addition, selection of the material should be aesthetically pleasing while providing the shear strength to withstand the weight and stresses arising from the weight of the glassware to be stored.

INDUSTRIAL APPLICABILITY

The present invention applies to convenient storage and display of stemmed glassware.

What is claimed is:

1. A rack for storing and displaying stemmed glassware comprising:

a main track, having open ends, for storing and displaying stemmed glassware;

a side track, intersecting the main track, having open ends, for receiving and transporting stemmed glassware thereto; and mounting holes for mounting the rack to a vertical or horizontal surface.

2. A rack as in claim 1 wherein the side track intersects the main track orthogonally.

3. A rack as in claim 1 wherein the main and side tracks comprise wide and narrow portions dimensioned to receive the base and stemmed portions of stemmed glasses of different dimensions.

4. A rack as in claim 3 wherein the main track width is adjustable.

* * * * *